US007077702B2

(12) United States Patent
Ward et al.

(10) Patent No.: US 7,077,702 B2
(45) Date of Patent: Jul. 18, 2006

(54) TERMINAL POSITION ASSURANCE WITH FORWARD INTERLOCKING FACE KEYING

(75) Inventors: Bobby Gene Ward, King, NC (US); Wolfgang Hoelscher, Stokesdale, NC (US); Joseph Edward Geniac, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/910,996

(22) Filed: Aug. 4, 2004

(65) Prior Publication Data

US 2005/0032423 A1 Feb. 10, 2005

Related U.S. Application Data

(60) Provisional application No. 60/492,690, filed on Aug. 5, 2003.

(51) Int. Cl.
*H01R 13/40* (2006.01)

(52) U.S. Cl. ..... 439/595; 439/292; 439/752

(58) Field of Classification Search ..... 439/595, 439/752, 695, 696, 686, 701
See application file for complete search history.

(56) References Cited

U.S. PATENT DOCUMENTS 2,591,437 A * 4/1952 Haugsrud ..... 439/290
2,928,998 A * 3/1960 Brumfield ..... 361/673
2,987,691 A * 6/1961 Ross ..... 439/294
3,112,974 A * 12/1963 Curtis et al. ..... 439/292
3,273,105 A * 9/1966 Klassen ..... 439/687
3,835,437 A * 9/1974 Gartland et al. ..... 439/106
4,014,601 A * 3/1977 Pittman ..... 439/58
4,477,022 A * 10/1984 Shuey et al. ..... 439/590
4,795,375 A * 1/1989 Williams ..... 439/680
4,820,204 A * 4/1989 Batty ..... 439/681
4,913,667 A * 4/1990 Muz ..... 439/733.1
5,071,369 A * 12/1991 Denlinger et al. ..... 439/595
5,282,753 A * 2/1994 Su ..... 439/106
5,501,606 A * 3/1996 Oda et al. ..... 439/140
5,533,909 A * 7/1996 Endo et al. ..... 439/381
5,558,526 A * 9/1996 Nagamine ..... 439/140
5,743,756 A * 4/1998 Hasz et al. ..... 439/364
5,857,867 A * 1/1999 Henry ..... 439/290
5,879,174 A * 3/1999 Kountz et al. ..... 439/141
5,890,922 A * 4/1999 Buchter et al. ..... 439/284
5,993,255 A * 11/1999 Yurko ..... 439/595
6,004,158 A * 12/1999 Ward ..... 439/595
6,030,244 A * 2/2000 Buckheit et al. ..... 439/291

(Continued)

FOREIGN PATENT DOCUMENTS

DE 27 08 291 * 8/1978

*Primary Examiner*—Gary F. Parsons
*Assistant Examiner*—Larisa Tsukerman

(57) ABSTRACT

A connector assembly comprising a cap member having a plurality of fixed cap terminal position assurance mechanisms defined thereon, and a plug member having one or more of fixed plug terminal position assurance mechanisms defined thereon, wherein each of the cap terminal position assurance mechanisms fixably mate with each of the plug terminal position assurance mechanisms, wherein each of the cap and plug terminal position assurance mechanisms comprise a post projecting outwardly from each of the cap member and the plug member, and a cutout configured to fixably mate to the post. The cutout maybe configured adjacent the post, wherein the cap/plug terminal position assurance mechanisms are arranged proximate an outer rim of the cap/plug member or the cap/plug terminal assurance mechanism may be located generally in the center of the interface manifold.

6 Claims, 6 Drawing Sheets

U.S. PATENT DOCUMENTS 6,068,521 A * 5/2000 Oros et al. ..... 439/681
6,089,901 A * 7/2000 Hatagishi et al. ..... 439/404
6,290,548 B1 * 9/2001 Yeh ..... 439/701
6,305,990 B1 * 10/2001 Ward ..... 439/752
6,354,852 B1 * 3/2002 Noro et al. ..... 439/157
6,409,525 B1 * 6/2002 Hoelscher et al. ..... 439/140
6,739,908 B1 * 5/2004 Hamai et al. ..... 439/587
2005/0032437 A1 * 2/2005 Johnescu et al. ..... 439/701

* cited by examiner

TERMINAL POSITION ASSURANCE WITH FORWARD INTERLOCKING FACE KEYING

CROSS REFERENCE TO RELATED APPLICATIONS

This application claims the benefit of U.S. Provisional Application Ser. No. 60/492,690 filed Aug. 5, 2003, which is hereby incorporated by reference in its entirety.

FIELD OF THE INVENTION

The present invention generally relates to terminal position assurance mechanisms, and more particularly to a terminal position assurance mechanism embodied with a forward interlocking face keying mechanism.

BACKGROUND OF THE INVENTION

Conventional connector assemblies, as used in automobiles and other vehicles, often face several types of problems. For example, one problem involves the engagement of the connector components. Because the electrical connector assembly is mated and then sealed, it is often difficult, if not impossible, to determine if the corresponding connectors are fully engaged with one another prior to catastrophic fatigue and failure. This is of particular concern when the assembly undergoes periods of vibration, which naturally occurs whenever the vehicle is in movement, or even if it is stationary and the engine is running.

Another problem involves unrestricted and excessive movement of the contact system within the electrical assembly housings, which invariably occurs during these periods of vibration. As such, contact stabilization systems have been devised to provide a proper stabilization of internal components. However, such conventional systems do not provide for proper alignment of internal assembly components, and the conventional designs simply allow too much internal component movement to occur, thereby causing failure of the internal assembly components, and of the assembly housings themselves.

Still another problem with the conventional stabilization devices is that it is difficult to determine if the internal components, themselves, have been fully seated within the connector housings, especially after the housings have been sealed. In fact, conventional stabilization mechanisms do not provide a proper manner with which to stabilize the plug housing component of the electrical connector assembly. This causes failures during vibration because the plug housing is not fully captured by the cap housing.

Terminal position assurance (TPA) members have been used to address this problem. For example, a TPA member may be a wedge-shaped structure pre-mounted to the front surface or mating interface of the housing. TPA members are commonly used on electrical connector assemblies, especially on electrical connectors used in the automotive industry. Conventionally, a TPA member is typically a freely movable (floatable) member that can be moved into its proper position only if all of the components in the connector are in their fully inserted position. The TPA member then pushes the internal electrical components and terminals in a direction opposite of terminal engagement, in order to fully seat them with respect to the remainder of the connector housing and then snaps into place.

Still another type of TPA member may include an insertable comb. The TPA comb can only be installed after the terminals have been fully inserted into the connector body and, usually, the TPA comb engages a shoulder of the terminal to interferingly prevent withdrawal of the terminals from the housing. Unfortunately, these conventional TPA devices do not provide adequate assurance that the internal terminals and other contact components are fully seated during periods of excessive vibration. Nor do these conventional TPA devices prevent movement of the internal components of the assembly.

Another problem with the conventional stabilization mechanisms is that all molds of the electrical connector housing assemblies must be changed depending on the type of TPA members being used. That is to say, the conventional designs are not robust.

As such, the conventional mechanisms do not provide sufficient stabilization for the mated pair assembly. Although the conventional mechanisms use TPA members to align the two mated halves, such TPA members do not provide any benefits to combat against vibration and rocking issues. Generally, because the TPA is a floating component within the assembly, it does not help stabilize the connector system interface. Moreover, such stabilization mechanisms employing these designs are not robust, and require significant tooling.

Therefore, there is a need for a novel fixed terminal position assurance mechanism embodied with a forward interlocking face keying mechanism, which allows for multiple configurations (robust design), is a stronger design, and prevents damage to internal assembly components during periods of vibration of the assemblies, and which requires less tooling and parts involved to effectuate a proper electrical connector housing assembly.

SUMMARY OF THE INVENTION

In view of the foregoing and other problems, disadvantages, and drawbacks of the conventional terminal position assurance mechanisms, various embodiments of the present invention are disclosed herein. It is an advantage of various embodiments of the present invention to provide a terminal position assurance mechanism operable in an electrical connector assembly. It is another advantage of embodiments of the present invention to provide a fixed terminal position assurance mechanism used in electrical connector assemblies, thereby providing increased strength for the assembly. Still another advantage of embodiments of the present invention is to provide a terminal position assurance mechanism used in electrical connector assemblies which prevents damage to internal assembly components during vibration. Yet another advantage of embodiments of the present invention is to provide a terminal position assurance mechanism used in electrical connector assemblies which decreases the tooling involved in producing the electrical connector assembly.

In order to attain the advantages suggested above, there is provided, according to one aspect, a connector assembly comprising a cap member having a plurality of fixed cap terminal position assurance mechanisms defined thereon, and a plug member having a plurality of fixed plug terminal position assurance mechanisms defined thereon, wherein each of the cap terminal position assurance mechanisms fixably mate with each of the plug terminal position assurance mechanisms.

In a preferred embodiment, each of the cap and plug terminal position assurance mechanisms comprise a generally curvilinear post projecting outwardly from each of the cap member and the plug member, and a generally curvilinear cutout configured adjacent the curvilinear post, wherein the cap/plug terminal position assurance mechanisms are arranged along an outer rim of the cap/plug member. Both the cap and plug members are generally rectangular in one embodiment and have four corners, wherein one of the cap and plug terminal position assurance mechanisms are arranged at each of the four corners respectively. The post of the cap/plug terminal position assurance mechanisms are mated with an oppositely positioned cutout of the plug/cap terminal position assurance mechanisms, wherein the cap/plug terminal position assurance mechanisms are arranged in multiple configurations.

In another preferred embodiment, each of the cap and plug terminal position assurance mechanisms comprise a generally rectangular post projecting outwardly from each of the cap member and the plug member, and a generally rectangular cutout configured to be matingly fixed to the post. Both the cap and the plug members are generally rectangular in one embodiment and have an interface manifold, wherein the cap/plug terminal position assurance mechanisms are arranged generally in the center of the interface manifold. The post of the cap/plug terminal position assurance mechanisms are mated with an oppositely positioned cutout of the plug/cap terminal position assurance mechanisms, wherein the cap/plug terminal position assurance mechanisms are arranged in multiple configurations.

In yet another preferred embodiment, both the cap and plug members are generally rectangular having an interface manifold and four corners, wherein one of the cap and plug terminal position assurance mechanisms are arranged at each of the four corners respectively and wherein additional cap and plug terminal assurance mechanisms are arranged generally in the center of the interface manifold. The post of the cap/plug terminal position assurance mechanisms are mated with an oppositely positioned cutout of the plug/cap terminal position assurance mechanisms, wherein the cap/plug terminal position assurance mechanisms are arranged in multiple configurations.

Embodiments of the present invention overcome the several disadvantages of the conventional designs, and in particular, has an advantage over conventional terminal position assurance mechanisms.

BRIEF DESCRIPTION OF THE DRAWINGS

The foregoing and other, aspects and advantages will be better understood from the following detailed description of the invention with reference to the drawings.

DETAILED DESCRIPTION

As previously mentioned, there is a need for a novel fixed terminal position assurance mechanism embodied with a forward interlocking face keying mechanism, which allows for multiple configurations (robust design), is a stronger design, and prevents damage to internal assembly components during periods of vibration of the assemblies, and which requires less tooling and parts involved to effectuate a proper electrical connector housing assembly. Embodiments of the present invention provide a fixed terminal position assurance mechanism operable in an electrical connector assembly, which provides increased assembly strength and allows for multiple configurations in the design of the assemblies, while simultaneously reducing the amount of tooling involved in the production of the housing assemblies. Additionally, the present invention provides terminal position assurance mechanisms that may also prevent improper mating of connectors.

Figure 1:
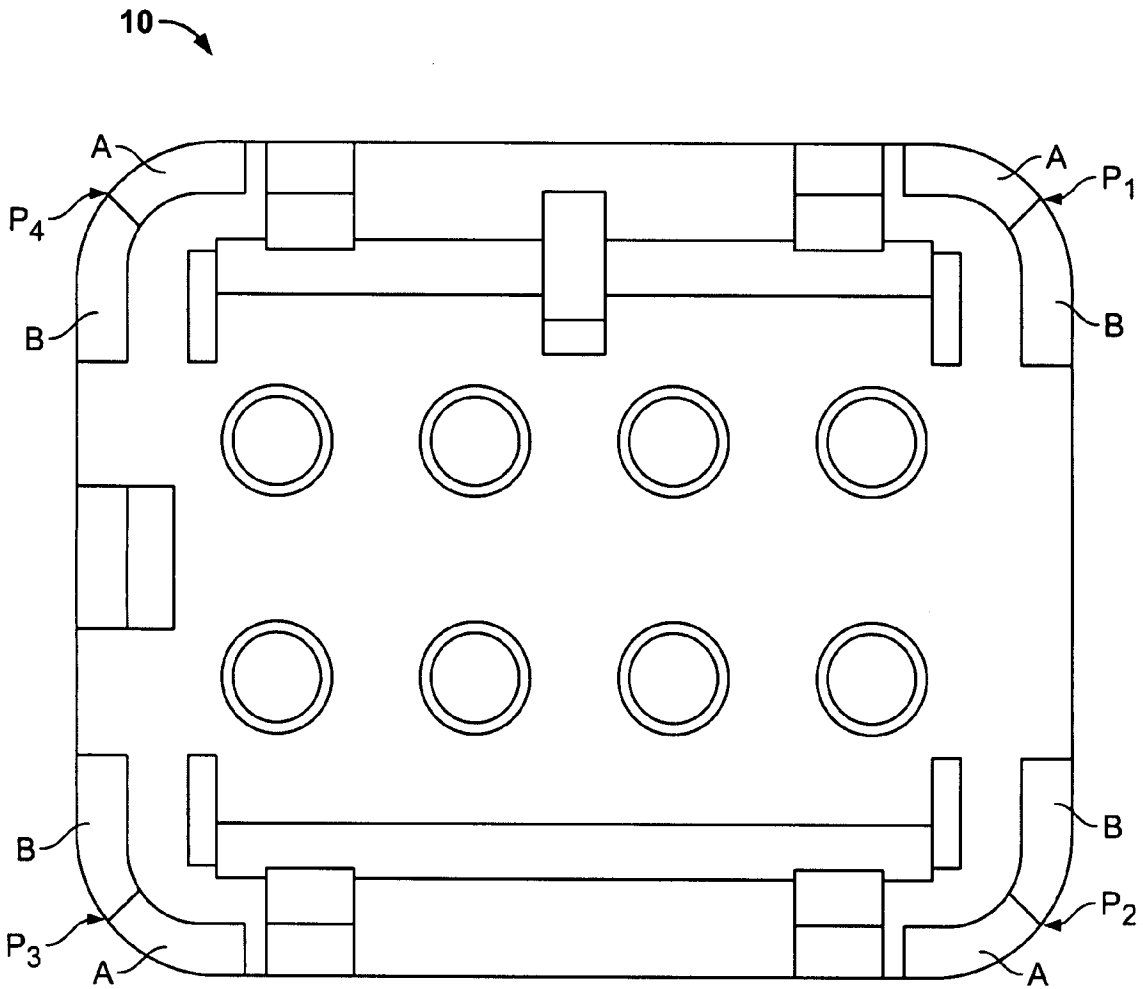
FIG. 1 is a top view of an electrical connector assembly comprising terminal position assurance mechanisms according to an embodiment of the present invention.
Figure 2:
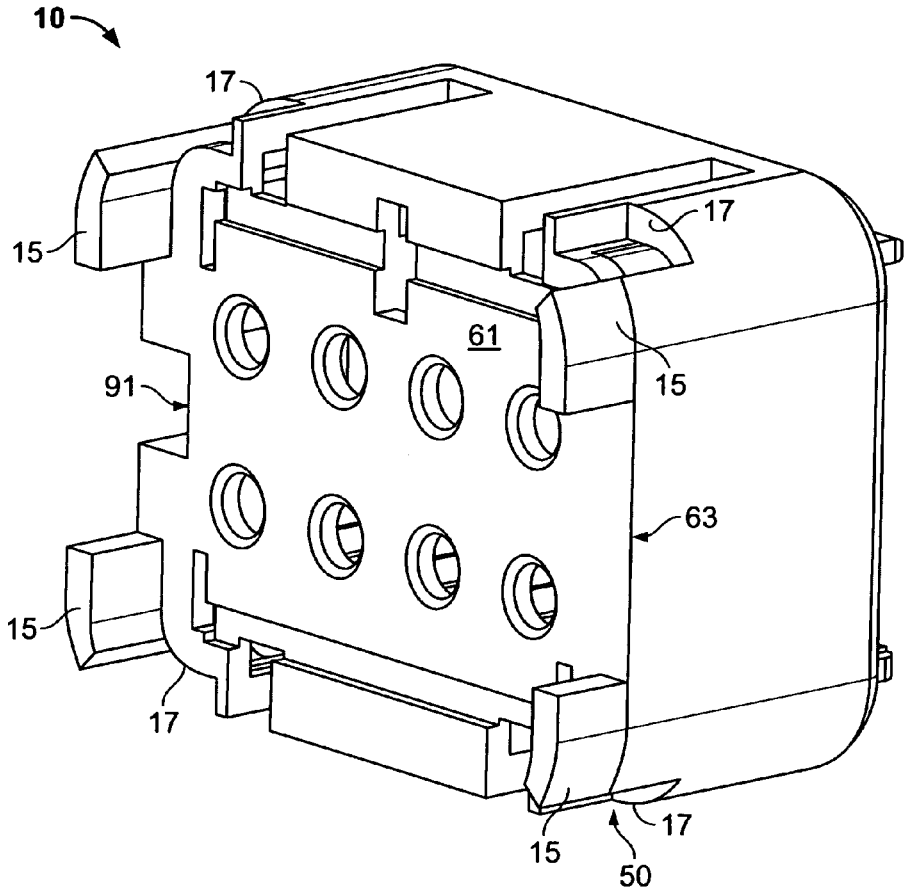
FIG. 2 is a perspective view of an electrical connector assembly comprising terminal position assurance mechanisms according to the embodiment shown in FIG. 1.
Figure 3:
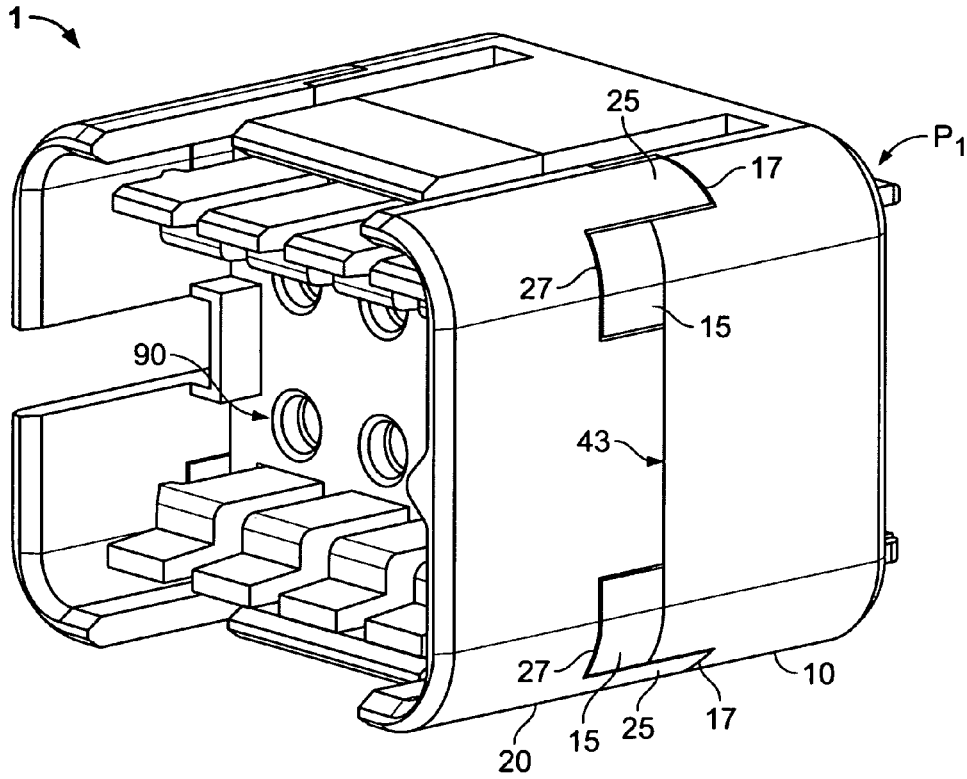
FIG. 3 is a side view of an electrical connector assembly comprising terminal position assurance mechanisms according to the embodiment shown in FIG. 1 shown in a closed position.

Referring now to the drawings, and more particularly to FIGS. 1 through 3, there are shown exemplary embodiments of the structures according to the present invention. Generally, as illustrated in FIGS. 1–3, a fixed terminal position assurance (TPA) mechanism 50 is shown adapted for in an electrical connector assembly 1 having a cap member 20 matingly attached to a plug member 10, wherein the terminal position assurance mechanism 50 comprises one or more posts 15, 25 and one or more cutouts 17, 27. In the present embodiment, preferably the posts 15, 25 and cutouts 17, 27 are each generally curvilinear in configuration. In the illustrated embodiment, each one of the cap 20 and plug member 10 is generally rectangular having four corners $P_1$, $P_2$, $P_3$, $P_4$, and wherein the terminal position assurance mechanism 50 is arranged at each of the four corners $P_1$, $P_2$, $P_3$, $P_4$ (rim TPAs). In other embodiments, the terminal position assurance mechanism 50 may be provided at less than each of the four corners and the cap member 20/plug member 10 may be comprised of other desired configurations, such as triangular as an example. The post 25 of the cap member 20 in the illustrated embodiment is mated with an oppositely positioned cutout 17 of the plug member 10, and conversely, the cutout 27 of the cap member 20 is mated with an oppositely positioned post 15 of the plug member 10. Moreover, the terminal position assurance mechanism 50 is preferably arranged in multiple configurations as will be described below.

Table 1 illustrates examples of configurations of the rim TPAs possible with the present embodiments. With reference made to FIG. 1, the relative positions of the rim terminal position assurance mechanisms are given by $P_n$, wherein n is in the range of 1 to 16. Also, the relative positions of the posts (P) and holes (H) are given by the generic position designations A and B, wherein for each rim TPA mechanism position $P_n$ located on each of a cap and a plug, there are two post/hole combinations wherein either A is positioned counterclockwise to B; or A is positioned clockwise to B. Thus, at each corner $P_1$, $P_2$, $P_3$, $P_4$ of the cap 20 and plug 10, there is configured a rim TPA, wherein the radius of the corner is divided into two sections: one being a hole 17, 27, while its counterpart is a post protrusion 15, 25. The corresponding matching rim TPA is defined in an opposite configuration. Therefore, if two opposite parts (cap 20 and plug 10) are mated, a solid union and alignment results, which holds electrical connector assembly 1 stably together.

TABLE 1

Examples of Multiple Configurations of Rim TPA Positions

| | | Position | | | | | | | |
|---|---|---|---|---|---|---|---|---|---|
| | | $P_1$ | | $P_2$ | | $P_3$ | | $P_4$ | |
| Configurations | | A | B | A | B | A | B | A | B |
| 1 | Cap | P | H | P | H | P | H | P | H |
| | Plug | H | P | H | P | H | P | H | P |
| 2 | Cap | H | P | H | P | H | P | H | P |
| | Plug | P | H | P | H | P | H | P | H |
| 3 | Cap | P | H | H | P | P | H | H | P |
| | Plug | H | P | P | H | H | P | P | H |
| 4 | Cap | H | P | P | H | H | P | P | H |
| | Plug | P | H | H | P | P | H | H | P |

With specific reference to FIGS. 1–3, an embodiment of the present invention illustrates an electrical connector assembly 1 comprising a generally rectangular cap portion 20 having four corners $P_1$, $P_2$, $P_3$, $P_4$; a generally rectangular plug portion 10 having four corners $P_1$, $P_2$, $P_3$, $P_4$, wherein the plug portion 10 is dimensioned and configured to mate with the cap portion 20; and a plurality of cap posts 25 extending from a lower surface 41 (not shown) of the cap portion 20, wherein the cap posts 25 are arranged along an outer edge 43 of the cap portion 20. The electrical connector assembly 1 further comprises a plurality of plug posts 15 extending from an upper surface 61 of the plug portion 10, wherein the plug posts 15 are arranged along an outer edge 63 of the plug portion 10.

The assembly 1 in the embodiment illustrated in FIGS. 1–3 also includes a plurality of cap cutouts 27 defined in the lower surface 41 of the cap portion 20, and a plurality of plug cutouts 17 defined in the upper surface 61 of the plug portion 10, wherein the cap cutouts 27 are arranged adjacent to the cap posts 25, and wherein the plug cutouts 17 are arranged adjacent to the plug posts 15. Furthermore, each one of the cap posts 25 and cap cutouts 27 are arranged at each of the four corners $P_1$, $P_2$, $P_3$, $P_4$. Likewise, each one of the plug posts 15 and plug cutouts 17 are arranged at each of the four corners $P_1$, $P_2$, $P_3$, $P_4$.

The cap posts 25 are mated with the oppositely positioned plug cutouts 17, while the plug posts 15 are mated with the oppositely positioned cap cutouts 27 during assembly. Additionally, the cap posts 25, plug posts 15, cap cutouts 27, and plug cutouts 17 are all generally curvilinear and wedge-shaped in the illustrated embodiment, although as understood, other shapes are also possible.

The plug housing 10 in the illustrated embodiment also includes a plug interface manifold 91, which provides for alignment with corresponding internal components when provided and alignment with a corresponding cap interface manifold 90. In the present embodiment, each of the cap posts 25, plug posts 15, cap cutouts 27, and plug cutouts 17 are able to be arranged in multiple configurations during production.

Figure 4:
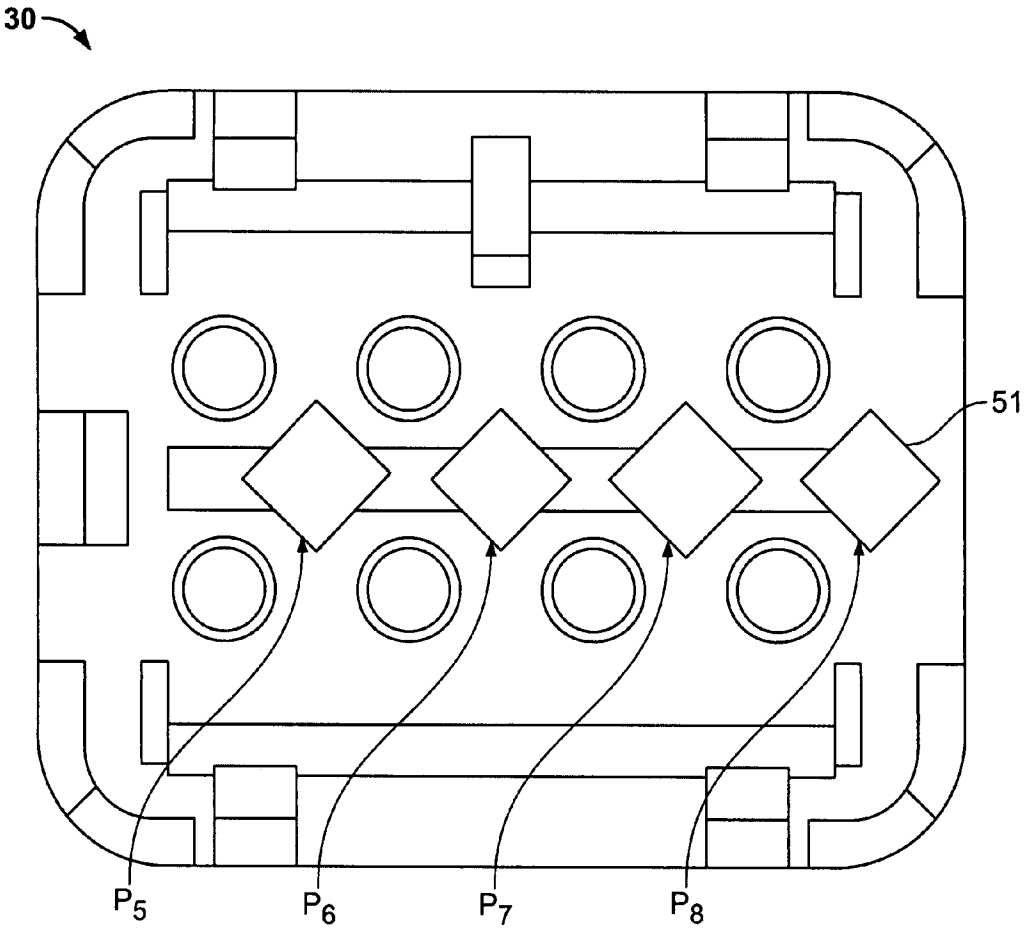
FIG. 4 is a top view of an electrical connector assembly comprising terminal position assurance mechanisms according to an alternative embodiment of the present invention.
Figure 5:
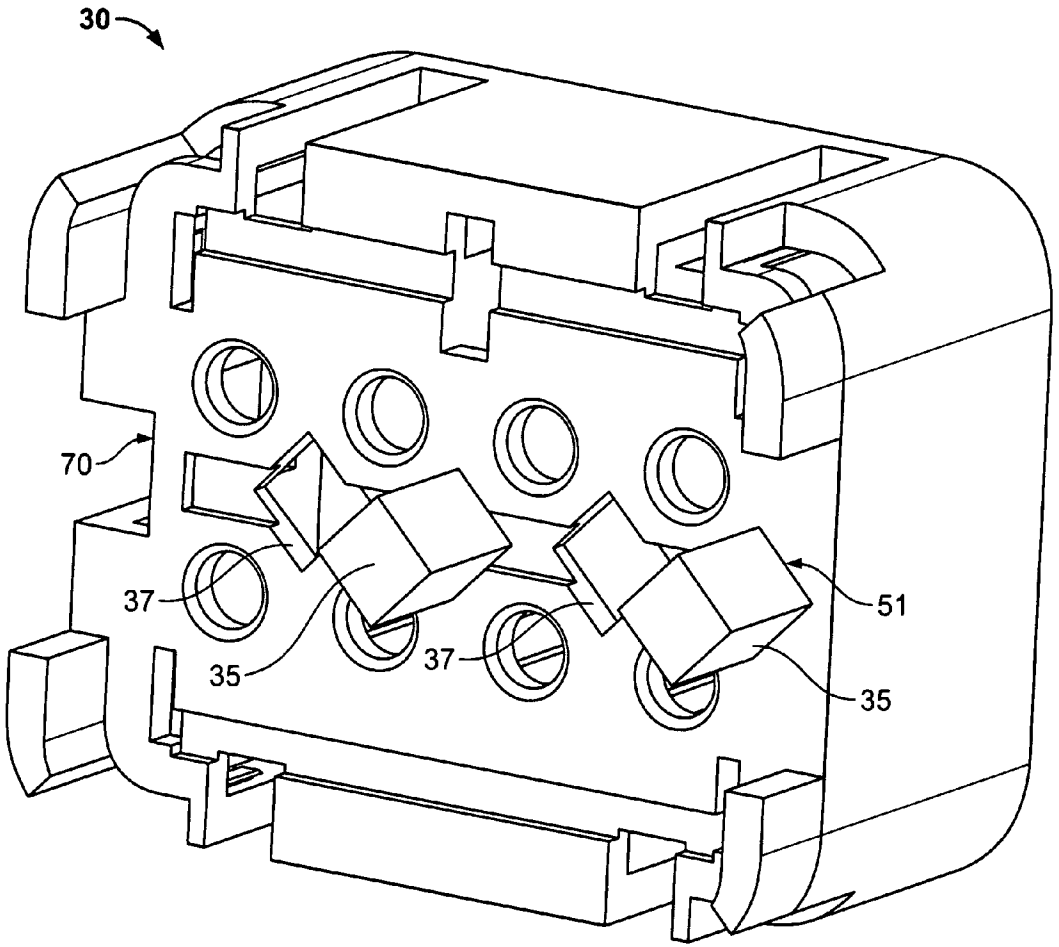
FIG. 5 is a perspective view of an electrical connector assembly comprising a terminal position assurance mechanisms according to the embodiment of the present invention as shown in FIG. 4.
Figure 6:
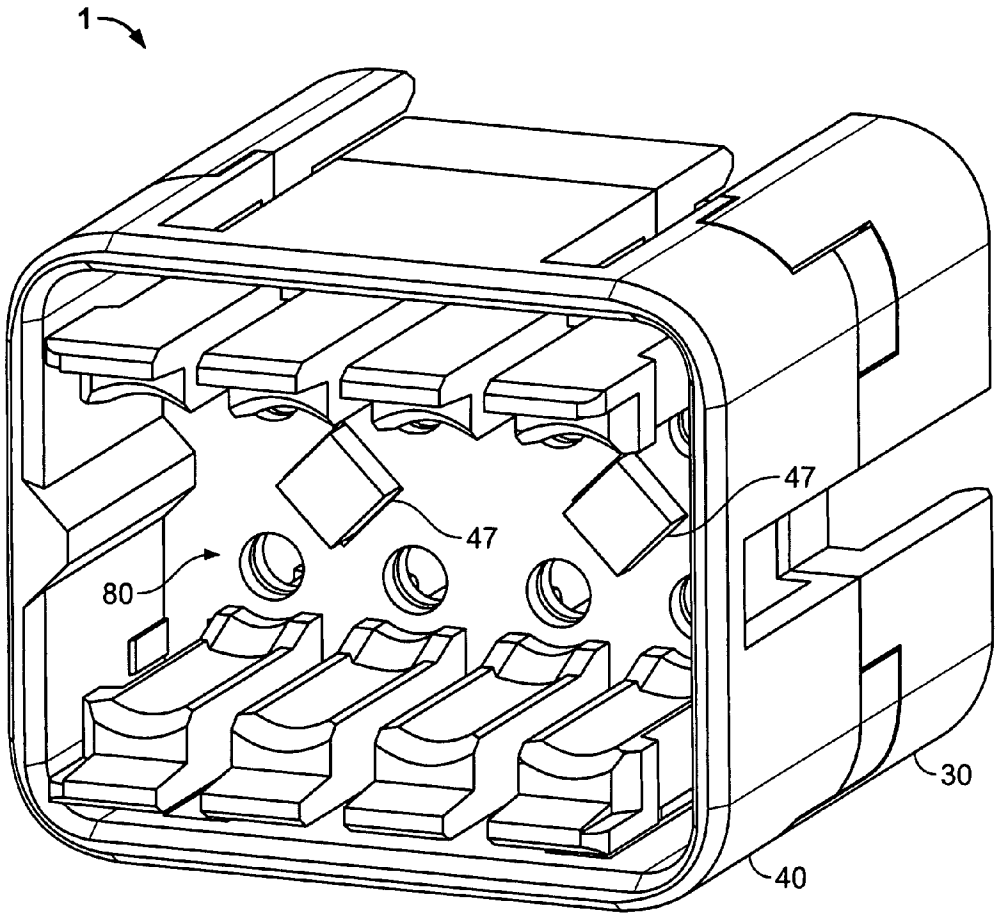
FIG. 6 is a side view of the electrical connector assembly comprising a terminal position assurance mechanisms as shown in FIG. 4 shown in a closed position.

Alternative embodiments of the present invention comprise center TPAs as shown on FIGS. 4–6. Generally, as illustrated in FIGS. 4–6, a center fixed terminal position assurance mechanism (center TPAs) 51 is shown adapted for in an electrical connector assembly 1 having a cap member 40 matingly attached to a plug member 30, wherein the terminal position assurance mechanism 51 comprises one or more posts 35, 45. In the present embodiment, preferably the posts 35, 45 and cutouts 37, 47 are each generally rectangular in configuration, however, one skilled in the art would know of other configurations which would be suitable. In the illustrated embodiment, each one of the cap member 40 and plug member 30 is generally rectangular having a plug interface manifold 70 and a cap interface manifold 80. In the illustrated embodiment, the center terminal position assurance mechanism 51 is arranged at four locations along the center surface of each interface manifold $P_5$, $P_6$, $P_7$, $P_8$. In other embodiments, the center terminal position mechanism 51 may be provided at less than each of the four locations and the cap 40/plug member 30 may be comprised of other desired configurations. The post 45 of the cap member 40 in the illustrated embodiment is mated with an oppositely positioned cutout 37 of the plug member 30, and conversely, the cutout 47 of the cap member 40 is mated with an oppositely positioned post 35 of the plug member 30. Moreover, the center terminal position assurance mechanism 51 is preferably arranged in multiple configurations as will be described below.

Table 2 illustrates an example of configurations possible for alternative embodiments of the present invention. With reference made to FIG. 4, the relative positions of the center terminal position assurance mechanisms are given by $P_n$, wherein n is in the range of 1 to 16, such that, for each TPA mechanism position $P_n$ located on each of a cap and a plug, there are two post/hole combinations of the posts (P) and holes (H). Thus, for each location $P_5$, $P_6$, $P_7$, $P_8$of the cap 40 and plug 30, there is configured a center TPA, one being a hole 37, 47, while its counterpart is a post protrusion 35, 45. The corresponding matching center TPA is defined in an opposite configuration. Therefore, if two opposite parts (cap 40 and plug 30) are mated, a solid union and alignment results, which holds the electrical connector assembly 1 stably together.

TABLE 2

Examples of Multiple Configurations of Center TPA Positions

| | | Position | | | |
|---|---|---|---|---|---|
| Configurations | | $P_5$ | $P_6$ | $P_7$ | $P_8$ |
| 1 | Cap | P | P | P | P |
| | Plug | H | H | H | H |
| 2 | Cap | H | H | H | H |
| | Plug | P | P | P | P |
| 3 | Cap | P | P | H | H |
| | Plug | H | H | P | P |
| 4 | Cap | P | H | H | H |
| | Plug | H | P | P | P |
| 5 | Cap | P | H | P | P |
| | Plug | H | P | H | H |
| 6 | Cap | H | H | H | P |
| | Plug | P | P | P | H |
| 7 | Cap | P | H | P | H |
| | Plug | H | P | H | P |
| 8 | Cap | P | P | H | P |
| | Plug | H | H | P | H |

With specific reference to FIGS. 4–6, in an alternative embodiment of the present invention, electrical connector assembly 1 comprises a generally rectangular cap member 40 having four center locations $P_5$, $P_6$, $P_7$, $P_8$; and a generally rectangular plug member 30 having four center locations $P_5$, $P_6$, $P_7$, $P_8$, wherein the plug member 30 is dimensioned and configured to mate with the cap member 40; and a plurality of cap posts 45 extending from, and/or a plurality of cap cutouts 47 defined in, cap interface manifold 80, wherein the cap posts 45 and/or cap cutouts 47 are arranged in the center portion of cap interface manifold 80 of the cap member 40. Electrical connector assembly 1 further comprises a plurality of plug posts 35 extending from, and/or a plurality of plug cutouts 37 defined in, the plug interface manifold 70 of plug member 30.

Yet other embodiments of the present invention may comprise one or more of the rim TPAs and one or more of the center TPAs. In an alternative embodiment of the present invention comprising one or more rim TPAs and one or more center TPAs, the center TPAs may provide for keying the mated connector and the rim TPAs may provide a stabilizer for the mated connector. Similarly, the rim TPAs may provide the keying feature and the center TPAs may provide the stabilizing feature. Additionally, the TPAs of the present invention may provide a mechanism for preventing the improper mating of incorrect connector members. In other words, where a combination of connector plugs are aligned with a combination of connector caps, each set of connector mating members may have a unique keying structure relating to different embodiments of the present invention that would prevent the inadvertent mating of two dissimilar connector members.

Embodiments of the present invention overcome the several disadvantages of the conventional designs, and in particular, has an advantage over conventional terminal position assurance mechanisms because a fixed terminal position assurance mechanism is provided operable in an electrical connector assembly, thereby providing increased strength for the assembly. Another advantage of embodiments of the present invention is that a terminal position assurance mechanism is provided for use in electrical connector assemblies which prevents damage to internal assembly components during vibration. Another advantage of the embodiments of present invention is that a terminal position assurance mechanism used in electrical connector assemblies which decreases the tooling involved for producing the electrical connector assembly.

Although this invention has been described with reference to particular embodiments, it will be appreciated that many variations may be resorted to without departing from the spirit and scope of this invention as set forth in the appended claims.

What is claimed is:

1. An electrical connector assembly comprising:

a cap member having one or more fixed cap terminal position assurance elements defined thereon; and a plug member having one or more fixed plug terminal position assurance elements defined thereon; and wherein each of the cap terminal position assurance elements is dimensioned and configured to fixably mate with each of the plug terminal position assurance elements; and wherein each cap and plug terminal position assurance element comprises:

a post projecting outwardly from-the respective cap member and plug member; and a cutout configured adjacent to the post;

wherein the post of each cap terminal position assurance element and plug terminal position assurance element is generally curvilinear;

wherein the post of the cap terminal position assurance elements are mated with an oppositely positioned cutout of each plug terminal position assurance elements; and wherein the cutout of each cap terminal position assurance element and plug terminal position assurance element is generally curvilinear.

2. The electrical connector assembly of claim 1, wherein each of the cap and plug member are generally rectangular having four corners, and wherein the terminal position assurance elements are arranged at each of said four corners.

3. The electrical connector assembly of claim 1, wherein the cap terminal position assurance elements are arranged along an outer rim of the cap member, and wherein the ping terminal position assurance elements are arranged along an outer rim of the plug member.

4. The electrical connector assembly of claim 1, wherein the post of each plug terminal position assurance elements are mated with an oppositely positioned cutout of each cap terminal position assurance elements.

5. The electrical connector assembly of claim 1, wherein the cap terminal position assurance elements are arranged in multiple configurations.

6. The electrical connector assembly of claim 1, wherein the plug terminal position assurance elements are arranged in multiple configurations.

* * * * *